US012742613B2

(12) United States Patent
Burayez

(10) Patent No.: US 12,742,613 B2
(45) Date of Patent: Sep. 22, 2026

(54) APPARATUS AND METHODS FOR AN OPTICAL REFLECTION GUNSIGHT

(71) Applicant: SureFire, LLC, Fountain Valley, CA (US)

(72) Inventor: Ammar Burayez, Fountain Valley, CA (US)

(73) Assignee: Surefire, LLC, Fountain Valley, CA (US)

( * ) Notice: Subject to any disclaimer, the term of this patent is extended or adjusted under 35 U.S.C. 154(b) by 4 days.

(21) Appl. No.: 18/949,059

(22) Filed: Nov. 15, 2024

(65) Prior Publication Data

US 2025/0164214 A1 May 22, 2025

Related U.S. Application Data

(60) Provisional application No. 63/599,743, filed on Nov. 16, 2023.

(51) Int. Cl.
*F41G 1/30* (2006.01)

(52) U.S. Cl.
CPC ..... *F41G 1/30* (2013.01)

(58) Field of Classification Search
CPC ... F41G 1/30; F41G 3/06; F41G 1/473; G02B 27/32
USPC ..... 42/111–123
See application file for complete search history.

(56) References Cited

U.S. PATENT DOCUMENTS

| | | | | |
|---|---|---|---|---|
| 3,861,803 | A * | 1/1975 | Sallans | F41G 1/30 356/255 |
| 3,897,158 | A * | 7/1975 | Steck, III | F41G 1/30 359/634 |
| 4,472,632 | A * | 9/1984 | Durenec | G02B 23/14 250/347 |
| 5,044,748 | A * | 9/1991 | Scott | G02B 27/32 42/131 |
| 9,593,909 | B2 * | 3/2017 | McRee | F41G 1/44 |
| 10,234,238 | B1 * | 3/2019 | Thomas | F41G 3/08 |
| 12,578,166 | B1 * | 3/2026 | Matthews | F41G 1/30 |
| 2010/0277295 | A1 * | 11/2010 | Matthews | F21V 23/0421 340/332 |
| 2013/0283660 | A1 * | 10/2013 | Matthews | F41G 1/26 42/118 |
| 2025/0164213 | A1 * | 5/2025 | Burayez | F41G 1/01 |

* cited by examiner

*Primary Examiner* — Michael D David
(74) *Attorney, Agent, or Firm* — Rutan & Tucker LLP; Hani Z. Sayed

(57) ABSTRACT

An apparatus and methods are provided for a gunsight and sighting system for use on firearms. The gunsight and sighting system comprises a mount portion coupled with a hood portion. A projection window with a collimated image overlay is secured to the mount portion by the hood portion. A front sight dot is forward of the projection window, while two rear sight dots are rearward of the mount portion. The sight dots may be illuminated by any of various desirable colors to enhance visibility in various lighting conditions. Light sensors disposed at the front of the mount portion detect ambient light and/or light in a target area and accordingly adjust the illumination of the sight dots. The light sensors may be disposed in asymmetric locations of the mounting portion to overcome interference due to light arriving at angles other than in front of the gunsight and sighting system.

17 Claims, 5 Drawing Sheets

APPARATUS AND METHODS FOR AN OPTICAL REFLECTION GUNSIGHT

PRIORITY

This application claims the benefit of and priority to U.S. Provisional Application, entitled "Apparatus And Methods For An Optical Reflection Gunsight," filed on Nov. 16, 2023, and having application Ser. No. 63/599,743, the entirety of said application being incorporated herein by reference.

FIELD

Embodiments of the present disclosure generally relate to firearms. More specifically, embodiments of the disclosure relate to an apparatus and methods for a gunsight and sighting system for use on firearms such as pistols, rifles, shotguns, grenade launchers and the like.

BACKGROUND

Gunsights are principally of three types, namely iron or open sights, telescopic sights, and electronic piper sights (e.g., laser, holographic, and/or projected sights). Iron sights are inexpensive, sturdy, and lightweight. A drawback to iron sights, however, is they require a shooter to line up a rear sight with a front sight and the target. It can be challenging to switch one's focus among the rear sight, the front sight, and the target as required while aiming a firearm. Further, a drawback to laser, holographic, and/or projected gunsights is that it can be difficult to acquire the aim piper in low light conditions, due to not quickly being able to see the image of the targeting piper. Another drawback to laser, holographic, and/or projected sights is that they are relatively slow to line up on a target, which is a substantial disadvantage in many military, police, and hunting situations.

What is needed, therefore, is a gunsight that facilitates rapid and accurate implementation of the Laser, holographic, and/or projected sight, while also performing reliably and accurately in varying light environments.

SUMMARY

An apparatus and methods are provided for a gunsight and sighting system for use on firearms. The gunsight and sighting system comprises a mount portion coupled with a hood portion. A projection window with a collimated image overlay is secured to the mount portion by the hood portion. A front sight dot is disposed forward of the projection window, while two rear sight dots are disposed at a rear of the mount portion. The sight dots may be illuminated by any of various desirable colors to enhance visibility in various lighting conditions. Light sensors are disposed at the front of the mount portion to detect ambient light and/or light in a target area and accordingly adjust the illumination of the sight dots. The light sensors may be disposed in asymmetric locations of the mounting portion to overcome interference due to light arriving at angles other than in front of the gunsight and sighting system.

In an exemplary embodiment, a projection window for gunsight and sighting system comprises: a generally cubic member having a front surface for receiving light from a target area; an exit surface for enabling an observer to view the target area; a Cassegrain portion for overlaying a collimated image of a reticle onto the view of the target area; and a spacer portion mated with the Cassegrain portion to form the cubic member.

In another exemplary embodiment, the projection window is a generally cubic member comprising a Cassegrain portion that is mated with a spacer portion. In another exemplary embodiment, the projection window includes a front surface and an exit surface opposite of the front surface. In another exemplary embodiment, the front surface is configured to receive light incoming from a target area while the exit surface is configured to enable an observer to view the target area. In another exemplary embodiment, the Cassegrain portion and the spacer portion comprise optically clear materials capable of directing a light path from a light source to the observer. In another exemplary embodiment, the projection window is formed of acrylic such that the reticle is not visible by way of the front surface.

In another exemplary embodiment, the spacer portion includes a mating surface that is configured to join with a partially mirrored surface of the Cassegrain portion. In another exemplary embodiment, the mating surface includes a specific topological shape so as to mate with the partially mirrored surface without any gaps or voids remaining therebetween. In another exemplary embodiment, the partially mirrored surface allows a portion of the light incoming from the target area to pass through the exit surface to the observer. In another exemplary embodiment, joining the Cassegrain portion and the spacer portion facilitates advantageously fitting the projection window within the hood portion. In another exemplary embodiment, a suitable adhesive is used to join the Cassegrain portion and the spacer portion to provide an enclosed and relatively short projection window.

In another exemplary embodiment, the Cassegrain portion includes a collimating surface and a fully mirrored surface. In another exemplary embodiment, the collimating surface is disposed below the partially mirrored surface and configured to receive light from a light source. In another exemplary embodiment, the light source is configured to form an image of the reticle on the exit surface. In another exemplary embodiment, the fully mirrored surface is configured to reflect light received through the collimating surface toward a partially mirrored surface comprising the Cassegrain portion. In another exemplary embodiment, light from the light source passing through the collimating surface is reflected by the fully mirrored surface toward the partially mirrored surface.

In another exemplary embodiment, the partially mirrored surface reflects light incident light toward the observer. In another exemplary embodiment, the partially mirrored surface allows light from the target area to pass through the exit surface to the observer. In another exemplary embodiment, a combination of light from the target area and light from the light source arriving at the exit surface provides an overlay of the reticle onto a display of the target area. In another exemplary embodiment, any one or more of the fully mirrored surface and the partially mirrored surface is configured to magnify the image of the target area and/or the reticle as viewed by the observer.

These and other features of the concepts provided herein may be better understood with reference to the drawings, description, and appended claims.

BRIEF DESCRIPTION OF THE DRAWINGS

The drawings refer to embodiments of the present disclosure in which.

Figure 1:
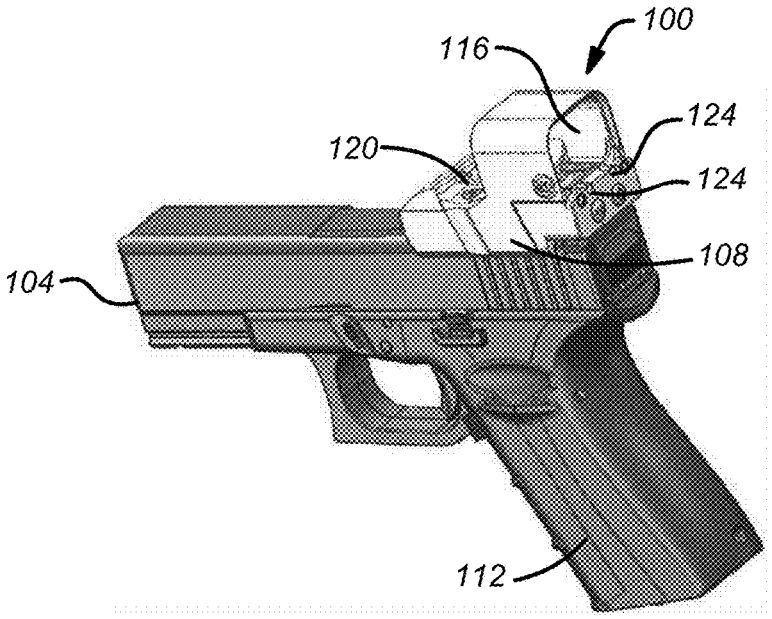
FIG. 1 illustrates a forward perspective view of an exemplary embodiment of a gunsight and sighting system mounted onto a handgun, according to the present disclosure.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the gunsight and methods disclosed herein may be practiced without these specific details. In other instances, specific numeric references such as "first sight," may be made. However, the specific numeric reference should not be interpreted as a literal sequential order but rather interpreted that the "first sight" is different than a "second sight." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

Although iron sights are inexpensive, sturdy, and lightweight, a drawback to iron sights is that they require a shooter to switch focusing on the rear sight, the front sight, and the target while aiming the firearm. A drawback to laser, holographic, and/or projected gunsights, meanwhile, is that it can be difficult to acquire the aim piper in low light conditions, due to not quickly being able to see the image of the targeting piper. Another drawback to laser, holographic, and/or projected sights is that they are relatively slow to line up on a target, which is a substantial disadvantage in many military, police, and hunting situations. Embodiments presented herein, however, provide a gunsight that facilitates rapid and accurate implementation of the Laser, holographic, and/or projected sight, while also performing reliably and accurately in varying light environments.

Figure 2:
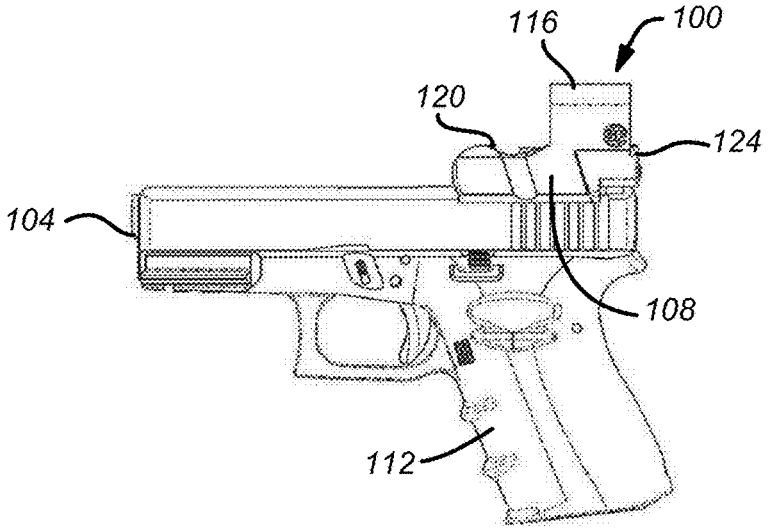
FIG. 2 illustrates a side view of an exemplary embodiment of a gunsight and sighting system mounted onto a handgun, according to the present disclosure.
Figure 3:
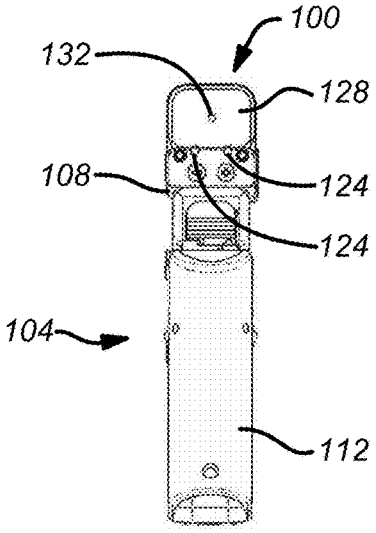
FIG. 3 illustrates a forward view of an exemplary embodiment of a gunsight and sighting system mounted onto a handgun in accordance with the present disclosure.

FIGS. 1-3 illustrate an exemplary embodiment of a gunsight and sighting system 100 mounted onto a firearm 104, according to the present disclosure. Although in the illustrated embodiment, the firearm 104 comprises a handgun, it should be understood that the firearm 104 may comprise any of various projectile weapons, such as rifles, shotguns, grenade launchers, and the like, as well as various weapons familiar to archery, such as long bows, crossbows, compound bows, and the like. Further, it is contemplated, that the firearm 104 may comprise any of various training weapons, or non-lethal weapons, such as BB guns, Airsoft guns, pellet guns, and directed laser weapons, and the like, without limitation.

As shown in FIGS. 1-3, the gunsight and sighting system 100 is coupled with a top of the firearm 104 by way of a mount portion 108. The system 100 preferably is mounted toward a rear of the firearm 104, such as directly above a grip 112 of the firearm 104 to facilitate visibility by a shooter. The mount portion 108 may be coupled with the firearm 104 by way of any of various mounting techniques, such as, by of non-limiting example, mounting onto a Picatinny rail comprising the slide of the handgun, mounting onto a rear sight dovetail of the handgun, coupling with the slide of handgun by way of a suitable adapter, or machining the slide specifically to receive the system 100.

In the illustrated embodiment, the gunsight and sighting system 100 comprises a projection window with collimated image overlay gunsight 116 coupled with an "iron sight" that serves as a secondary sight should the projection window with collimated image overlay gunsight 116 fail to operate correctly. The iron sight comprises at least one front sight dot 120 and at least two rear sight dots 124. As best shown in FIG. 3, the rear sight dots 124 are disposed below a projection window 128 that includes a collimated image overlay of a reticle 132. It is contemplated that a shooter can accurately aim the firearm 104 by aligning the front sight dot 120 with a target while centering the front sight dot 120 between the rear sight dots 124 or by aligning the reticle 132 with the target. The proximity of the front and rear sight dots 120, 124 and the projection window 128 obviates the shooter having to shift focus among the front and rear sight dots 120, 124, the reticle 132, and the target.

Figure 4:
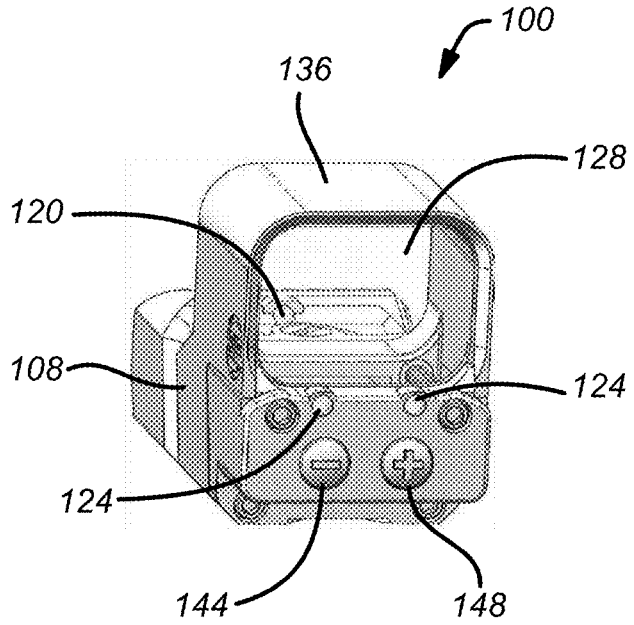
FIG. 4 illustrates a forward perspective view of an exemplary embodiment of a gunsight and sighting system in accordance with the present disclosure.
Figure 5:
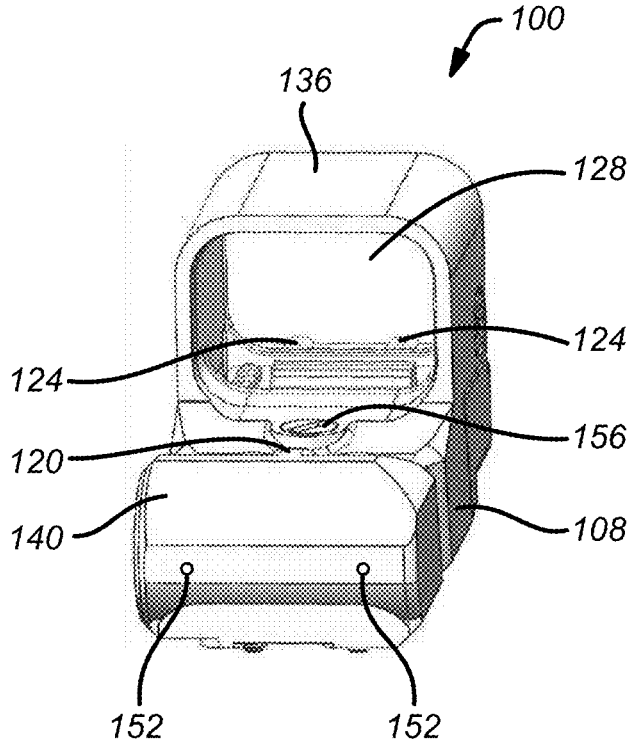
FIG. 5 illustrates a rearward perspective view of an exemplary embodiment of a gunsight and sighting system in accordance with the present disclosure.

FIGS. 4-7 illustrate the gunsight and sighting system 100 in greater detail. As shown in FIGS. 4-5, the system 100 generally comprises the mount portion 108 and a hood portion 136. The hood portion 136 couples the projection window 128 with the mount portion 108. The hood portion 136, as well as the mount portion 108, may comprise a rigid material such as metal or plastic to protect the projection window 128 and internal circuitry and components comprising the system 100. The mount portion 108 further comprises a battery compartment 140. As will be appreciated, the battery compartment 140 is configured to house a suitably sized battery for powering the internal circuitry and components comprising the system 100, as described herein.

Figure 6:
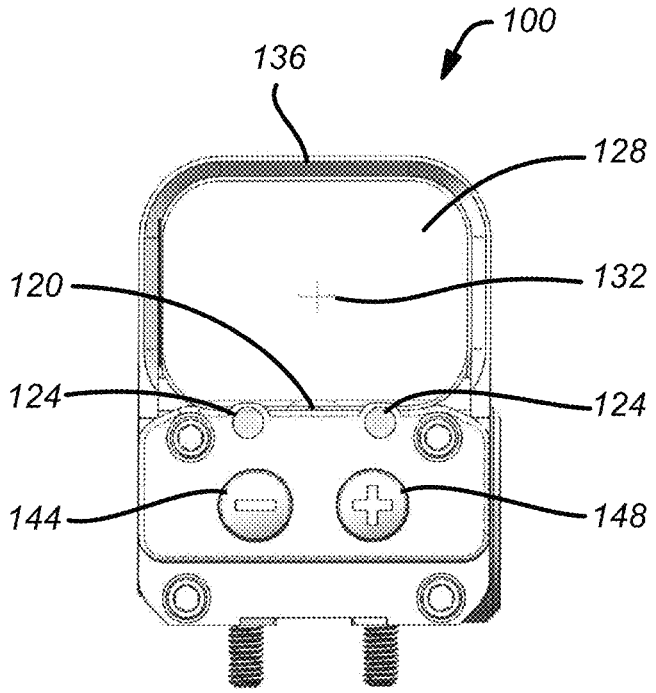
FIG. 6 is a forward view of an exemplary embodiment of a gunsight and sighting system, illustrating a reticle as viewed by a shooter, according to the present disclosure.
Figure 7:
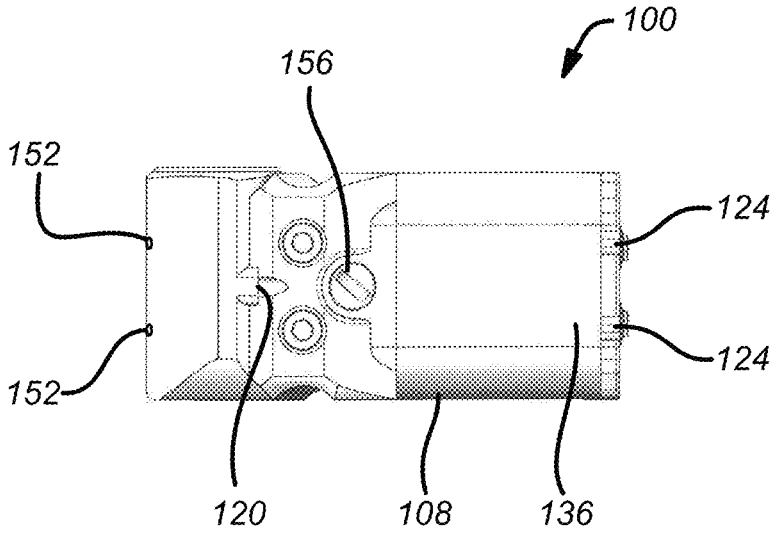
FIG. 7 illustrates a top view of an exemplary embodiment of a gunsight and sighting system, according to the present disclosure.

With continuing reference to FIGS. 4-5, the front sight dot 120 is disposed above the battery compartment 140 and in front of the projection window 128 (see FIG. 7). The rear sight dots 124 are disposed at a rear of the mount portion 108 (see FIG. 6) and below the projection window 128. As such, the shooter may aim the firearm 104 by viewing a target and the front sight dot 120 through the projection window 128 while centering the front sight dot 120 between the rear sight dots 124. It is contemplated, therefore, that the front and rear sight dots 120, 124 may be used as a secondary sight in an event wherein the reticle 132 is not displayed in the projection window 128.

In some embodiments, any one or more of the front and rear sight dots 120, 124 are configured to be backlit so as to enhance visibility in various lighting conditions. Any of various desirable colors, or multiple colors, may be incorporated into the front and rear sight dots 120, 124. It is contemplated that the illumination of the front and rear sight dots 120, 124 may be achieved by way of a suitable electronically controlled lighting source, such as by way of an LED or chemical light generator with an electrical or mechanical adjustment system. For example, the brightness of the illuminated front and rear sight dots 120, 124 may be controlled by way of a Decrease Brightness button 144 and an Increase Brightness button 148. As will be appreciated, the shooter may dim the illumination of the front and rear sight dots 120, 124 by pressing the Decrease Brightness button 144, while the shoot may press the Increase Brightness button 148 to increase the illumination of the front and rear sight dots 120, 124.

As best shown in FIGS. 5 and 7, light sensors 152 may be disposed at a front of the mount portion 108. The light sensors 152 are configured to detect ambient light and/or the amount of light in a target area and signal the lighting source to accordingly increase or decrease the illumination of the front and rear sight dots 120, 124. It is contemplated that the forward position of the light sensors 152 are configured to detect and accommodate changing ambient lighting such as occurs when entering or exiting a differently lit room. Further, in some embodiments, the light sensors 152 may be disposed in asymmetric locations of the mounting portion 108 and configured to communicate with one another so as to overcome interference due to light arriving at angles other than in front of the system 100. Further, in some embodiments, the light sensors 152 may be configured to adjust the brightness of the reticle 132 and the front and rear sight dots 120, 124 simultaneously.

FIG. 6 illustrates a forward view of an exemplary embodiment of a gunsight and sighting system 100, showing a reticle 132 as may be viewed by a shooter, according to the present disclosure. As described hereinabove, the gunsight and sighting system 100 comprises a projection window with collimated image overlay gunsight 116 coupled with an iron sight that can serve as a secondary sight should the projection window with collimated image overlay gunsight 116 fail to operate correctly. The iron sight comprises at least one front sight dot 120 and at least two rear sight dots 124 that can be viewed simultaneously with a projection window 128 that includes a collimated image overlay of a reticle 132. As such, the shooter can accurately aim the firearm 104 by aligning the front sight dot 120 with a target while centering the front sight dot 120 between the rear sight dots 124 or by aligning the reticle 132 with the target. It is contemplated that the proximity of the front and rear sight dots 120, 124 and the projection window 128 obviates the shooter having to shift focus among the front and rear sight dots 120, 124, the reticle 132, and the target.

As will be appreciated, the gunsight and sighting system 100 may include adjustment configured to enable a practitioner to the position of the reticle 132 to account for elevation and windage. As best shown in FIG. 7, an elevation adjustment screw 156 may be incorporated into a top of the mount portion 108 while a windage adjustment screw (not shown) may be incorporated into a side of the mount portion 108. Various other implementations of the elevation adjustment screw 156 and the windage adjustment screw will be apparent to those skilled in the art without deviating beyond the spirit and the scope of the present disclosure.

Figure 8:
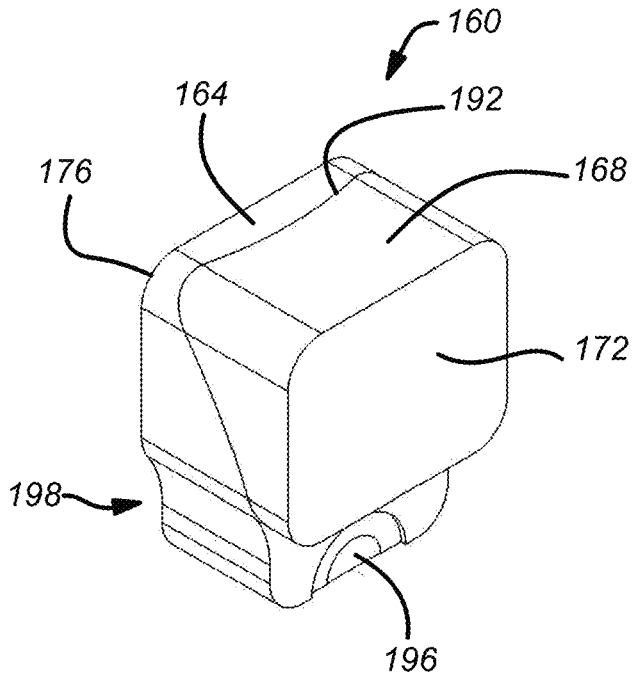
FIG. 8 illustrates a rearward isometric view of an exemplary embodiment of a projection window with a collimated image overlay according to the present disclosure.

FIGS. 8-12 illustrate an exemplary embodiment of a projection window with a collimated image overlay 160 that may be incorporated into the gunsight and sighting system 100, according to the present disclosure. As shown in FIG. 8, the projection window with the collimated image overlay 160 is a generally cubic member comprising a Cassegrain portion 164 that is mated with a spacer portion 168, as described herein. The projection window with the collimated image overlay 160 includes a front surface 172 and an exit surface 176 opposite of the front surface 172. The front surface 172 receives light incoming from a target area while the exit surface 176 enables an observer 180 (see FIG. 10), such as a shooter, to see a reticle 184 overlayed onto the target area (see FIG. 12). The Cassegrain portion 164 and the spacer portion 168 generally comprise optically clear materials, such as acrylic, capable of directing a light path from a light source to the observer 180, as described herein.

Figure 9:
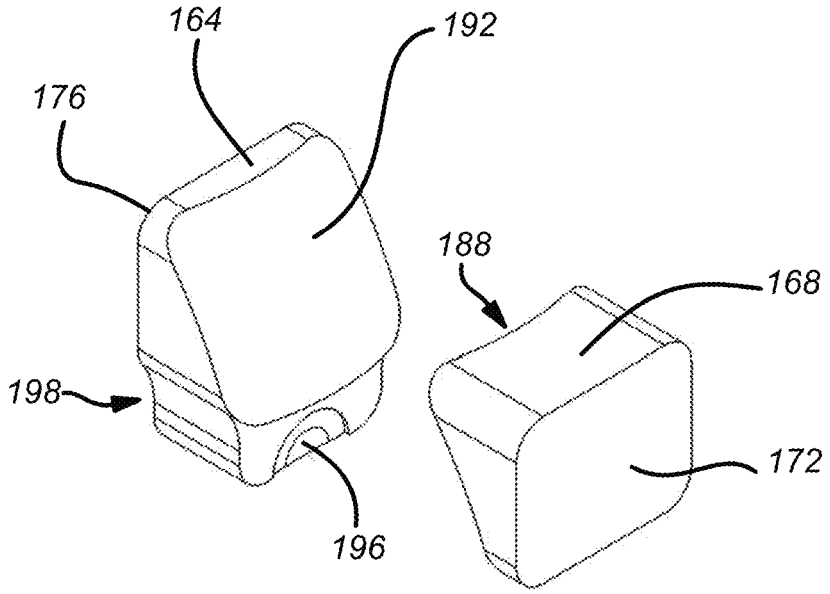
FIG. 9 illustrates a rearward isometric exploded view of the projection window of FIG. 8, showing a Cassegrain and a spacer.

As best shown in FIG. 9, the spacer portion 168 includes a mating surface 188 that is configured to join with a partially mirrored surface 192 of the Cassegrain portion 164. As will be appreciated, the mating surface 188 generally includes a specific topological shape, such as one or more degrees of curvature, so as to mate with the partially mirrored surface 192 without any gaps or voids remaining therebetween. Further, the partially mirrored surface 192 allows a portion of the light incoming from the target area to pass through the exit surface 176 to the observer 180. It is contemplated that joining the Cassegrain portion 164 and the spacer portion 168, as shown in FIG. 8, facilitates advantageously fitting the projection window with the collimated image overlay 160 within the hood portion 136, as discussed in connection with FIGS. 4-5. Further, it is contemplated that any of various suitable adhesives may be used to join the Cassegrain portion 164 and the spacer portion 168, such that projection window with the collimated image overlay 160 is enclosed and relatively short so that debris and ambient light doesn't affect the optical path as often occurs in "open air" systems.

As further shown in FIGS. 8-9, the Cassegrain portion 164 includes a collimating surface 196 and a fully mirrored surface 198. The collimating surface 196 is disposed below the partially mirrored surface 192 and configured to receive light from a light source 200 (see FIG. 10) that may be incorporated into the gunsight and sighting system 100, as described herein. The fully mirrored surface 198 meanwhile is configured to reflect light received through the collimating surface 196 toward the partially mirrored surface 192, as described herein.

Figure 10:
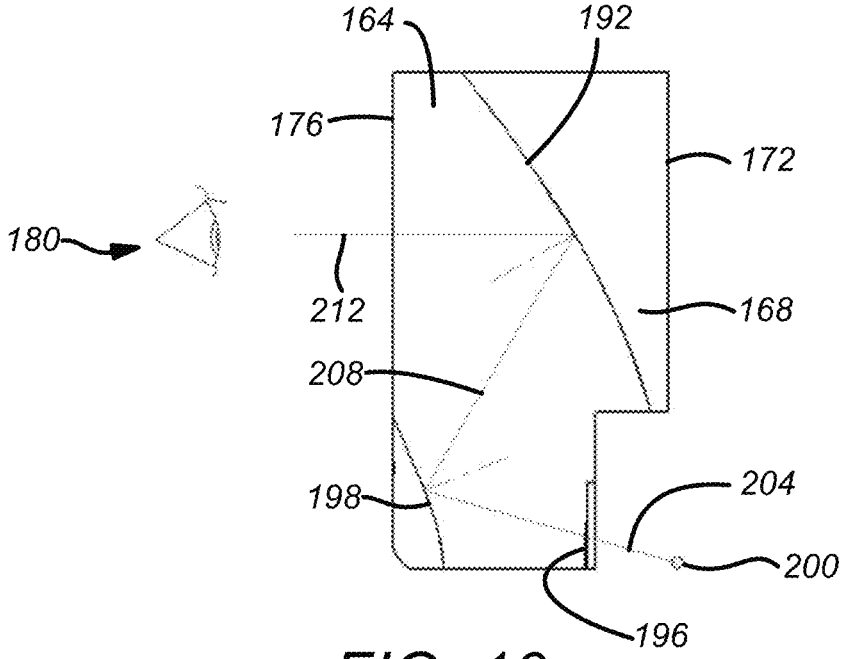
FIG. 10 is a cross-sectional view of an exemplary embodiment of a projection window with a collimated image overlay, showing a path between internal and external optical surfaces taken by light traveling from a light source to an observer's eye.

Turning to FIG. 10, a path taken by light traveling from a light source 200, through the Cassegrain portion 164 to the observer 180 is shown. The light source 200 may comprise any source of light, such as an LED, laser, or hologram, that is suitable for forming an image of the reticle 184 on the exit surface 176. As shown in FIG. 10, light from the light source 200 traveling along a light path 204 passes through the collimating surface 196. In some embodiments, the collimating surface 196 comprises a collimating lens configured to form an image of the light source 200 to be viewed at a size reasonable for human visualization. Further, the collimating lens may be configured to focus the image of the light source 200 such that the light source 200 appears to be in focus with light incoming from the target area, as viewed through the exit surface 176.

With continuing reference to FIG. 10, light exiting the collimating surface 196 travels along light path 204 to the fully mirrored surface 198. The fully mirrored surface 198 reflects the light onto a light path 208 through the Cassegrain portion 164 toward the partially mirrored surface 192. The partially mirrored surface 192 reflects the arriving light onto a light path 212 toward the observer 180. Simultaneously, the partially mirrored surface 192 allows light from the target area, incoming through the spacer portion 168, to pass through the exit surface 176 to the observer 180.

Figure 12:
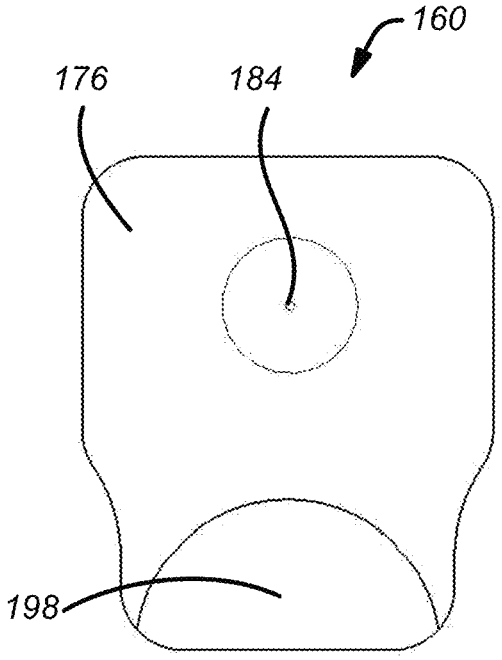
FIG. 12 illustrates a rear side view of an exemplary embodiment of a projection window with a collimated image overlay, in accordance with the present disclosure.

As shown in FIG. 12, the combination of light from the target area and light from the light source 196 (see FIG. 10) arriving at the exit surface 176 results in an overlay of the reticle 184 onto a display of the target area. In some embodiments, the topological shapes, such as one or more degrees of curvature, of either or both of the fully mirrored surface 198 and the partially mirrored surface 192 can be configured to magnify the image of the target area and/or the reticle 184 as viewed by the observer 180. It is contemplated that this magnification provides for a relatively small and compact adjustment mechanism comprising the gunsight and sighting system 100.

Figure 11:
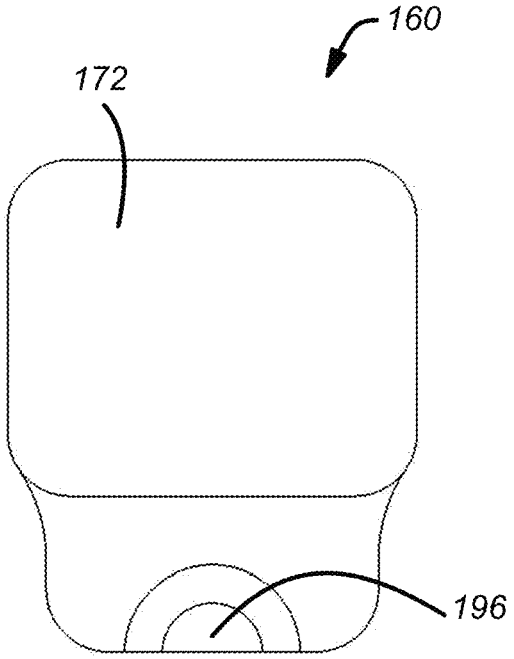
FIG. 11 illustrates a front side view of an exemplary embodiment of a projection window with a collimated image overlay according to the present disclosure.

FIG. 11 illustrates a front side view of an exemplary embodiment of a projection window with a collimated image overlay 160, while FIG. 12 illustrates a rear side view of the projection window with the collimated image overlay 160, in accordance with the present disclosure. As shown in FIG. 11, a front surface 172 is disposed above the collimating surface 196. Further, an exit surface 176 is disposed above a fully mirrored surface 198, as shown in FIG. 12. The front surface 172 and the exit surface 176 are generally planar surfaces. The front surface 172 receives light incoming from a target area while the exit surface 176 enables an observer 180 (see FIG. 10), such as a shooter, to see the reticle 184 overlayed onto the target area, as shown in FIG. 12. It is contemplated that the projection window with the collimated image overlay 160 may be formed of acrylic such that the reticle 184 is not displayed in the front surface 172, thereby hiding the operating location of the observer 180 from opponents.

In some embodiments, the brightness of reticle 184 may be altered, as may be desired by the observer 180 to accommodate the effects of ambient light. For example, the brightness of reticle 184 may be controlled by way of the Decrease Brightness button 144 and the Increase Brightness button 148. As will be appreciated, the observer 180 may dim the illumination of the reticle 184 by pressing the Decrease Brightness button 144, while the observer 180 may press the Increase Brightness button 148 to increase the illumination of the reticle 184. Further, in some embodiments, the light sensors 152 may be configured to adjust the brightness of the reticle 184 to accommodate changing ambient lighting such as occurs when entering or exiting a differently lit room.

While the gunsight and methods have been described in terms of particular variations and illustrative figures, those of ordinary skill in the art will recognize that the gunsight is not limited to the variations or figures described. In addition, where methods and steps described above indicate certain events occurring in certain order, those of ordinary skill in the art will recognize that the ordering of certain steps may be modified and that such modifications are in accordance with the variations of the gunsight. Additionally, certain of the steps may be performed concurrently in a parallel process when possible, as well as performed sequentially as described above. To the extent there are variations of the gunsight, which are within the spirit of the disclosure or equivalent to the gunsight found in the claims, it is the intent that this patent will cover those variations as well. Therefore, the present disclosure is to be understood as not limited by the specific embodiments described herein, but only by scope of the appended claims.

What is claimed is:

1. A projection window for gunsight and sighting system, comprising:

a generally cubic member having a front surface for receiving light from a target area;

an exit surface for enabling an observer to view the target area;

a Cassegrain portion for overlaying a collimated image of a reticle onto the view of the target area; and a spacer portion mated with the Cassegrain portion to form the cubic member wherein the projection window includes a front surface and an exit surface opposite of the front surface;

wherein the Cassegrain portion and the spacer portion comprise optically clear materials capable of directing a light path from a light source to the observer; and wherein the projection window is formed of acrylic such that the reticle is not visible by way of the front surface.

2. The system of claim 1, wherein the projection window is a generally cubic member comprising a Cassegrain portion that is mated with a spacer portion.

3. The system of claim 1, wherein the front surface is configured to receive light incoming from a target area while the exit surface is configured to enable an observer to view the target area.

4. The system of claim 1, wherein the spacer portion includes a mating surface that is configured to join with a partially mirrored surface of the Cassegrain portion.

5. The system of claim 4, wherein the mating surface includes a specific topological shape so as to mate with the partially mirrored surface without any gaps or voids remaining therebetween.

6. The system of claim 4, wherein the partially mirrored surface allows a portion of the light incoming from the target area to pass through the exit surface to the observer.

7. The system of claim 4, wherein joining the Cassegrain portion and the spacer portion facilitates advantageously fitting the projection window within the hood portion.

8. The system of claim 4, wherein a suitable adhesive is used to join the Cassegrain portion and the spacer portion to provide an enclosed and relatively short projection window.

9. The system of claim 1, wherein the Cassegrain portion includes a collimating surface and a fully mirrored surface.

10. The system of claim 9, wherein the collimating surface is disposed below the partially mirrored surface and configured to receive light from a light source.

11. The system of claim 10, wherein the light source is configured to form an image of the reticle on the exit surface.

12. The system of claim 9, wherein the fully mirrored surface is configured to reflect light received through the collimating surface toward a partially mirrored surface comprising the Cassegrain portion.

13. The system of claim 12, wherein light from the light source passing through the collimating surface is reflected by the fully mirrored surface toward the partially mirrored surface.

14. The system of claim 13, wherein the partially mirrored surface reflects light incident light toward the observer.

15. The system of claim 14, wherein the partially mirrored surface allows light from the target area to pass through the exit surface to the observer.

16. The system of claim 15, wherein a combination of light from the target area and light from the light source arriving at the exit surface provides an overlay of the reticle onto a display of the target area.

17. The system of claim 16, wherein any one or more of the fully mirrored surface and the partially mirrored surface is configured to magnify the image of the target area and/or the reticle as viewed by the observer.

* * * * *